US006792779B1

(12) United States Patent
Shen

(10) Patent No.: US 6,792,779 B1
(45) Date of Patent: Sep. 21, 2004

(54) LOCKING DEVICE OPERATED BY BOTH OF THE MECHANICAL AND MAGNETIC EFFECTS

(76) Inventor: Kou-Chi Shen, 1F, No. 5, Alley 6, Lane 166, Shin-Yi Rd, Sec. 3, Taipei (TW)

( * ) Notice: Subject to any disclaimer, the term of this patent is extended or adjusted under 35 U.S.C. 154(b) by 0 days.

(21) Appl. No.: 10/694,099

(22) Filed: Oct. 27, 2003

(51) Int. Cl.[7] ..... E05B 67/24; E05B 47/06

(52) U.S. Cl. ..... 70/38 B; 70/277; 70/278.3; 70/278.7

(58) Field of Search ..... 70/278.3, 277, 70/257, 279.1, 63, 38 A, 38 B, 38 C, 408, 278.7

(56) References Cited

U.S. PATENT DOCUMENTS 4,609,780 A * 9/1986 Clark ..... 379/102.06
4,838,052 A * 6/1989 Williams et al. ..... 70/63
4,851,652 A * 7/1989 Imran ..... 235/382
5,090,222 A * 2/1992 Imran ..... 70/63
5,561,996 A * 10/1996 Chang ..... 70/247
5,775,148 A * 7/1998 Layton et al. ..... 70/408
6,050,118 A * 4/2000 Kito ..... 70/456 R
6,731,212 B2 * 5/2004 Hirose et al. ..... 340/572.9

* cited by examiner

*Primary Examiner*—Lloyd A. Gall
(74) *Attorney, Agent, or Firm*—Alan D. Kamrath; Nikolai & Mersereau, P.A.

(57) ABSTRACT

A locking device includes a housing, a base, an electromagnetic sensor, a locking hook, a locking mechanism having a locking bolt and a linking member, and a key having a first end formed with a mechanical unlocking portion and a second end formed with an electromagnetic unlocking portion. Thus, the locking device can be opened by the mechanical unlocking portion of the key and the electromagnetic unlocking portion of the key, thereby enhancing the versatility of the locking device.

20 Claims, 8 Drawing Sheets

LOCKING DEVICE OPERATED BY BOTH OF THE MECHANICAL AND MAGNETIC EFFECTS

BACKGROUND OF THE INVENTION

1. Field of the Invention

The present invention relates to a locking device, and more particularly to a locking device that is operated by both of the mechanical and magnetic effects.

2. Description of the Related Art

A conventional mechanical locking device can be opened by a key in a mechanical operated manner, and a conventional electronic locking device can be opened by a magnetic card. However, the conventional locking device can be opened by both of the mechanical and magnetic effects, thereby limiting the versatility of the conventional locking device.

SUMMARY OF THE INVENTION

The primary objective of the present invention is to provide a locking device that is operated by both of the mechanical and magnetic effects.

Another objective of the present invention is to provide a locking device that can be opened by the mechanical unlocking portion of the key and the electromagnetic unlocking portion of the key, thereby enhancing the versatility of the locking device.

In accordance with the present invention, there is provided a locking device, comprising:

a housing;

a base mounted in the housing and having an upper portion formed with an upper receiving space, a through hole located beside the upper receiving space, a locking hole located beside the upper receiving space, and a receiving hole located between the through hole and the locking hole for mounting a locking core, the base having a mediate portion formed with a transverse guide slot and having a lower portion formed with a lower receiving space having a backside formed with a battery seat;

an electromagnetic sensor mounted in the lower receiving space of the base to connect an electromagnetic valve mounted in the upper receiving space of the base, the electromagnetic sensor detecting electromagnetic waves to drive the electromagnetic valve which drives a protruding locking pin to retract into the electromagnetic valve;

a locking hook having a bent mediate portion and having a first end extended into the through hole of the base and urged on a first elastic member and a second end formed with a locking recess inserted into the locking hole of the base;

a locking mechanism including a locking bolt, and a linking member;

the locking bolt having a first side formed with a wedge-shaped locking lug and a second side formed with a stub for mounting a second elastic member which urges the locking lug to extend into the locking hole of the base, the locking bolt having an upper portion formed with an opening located between the locking lug and the stub and a lower portion formed with a vertical stop located between the locking lug and the stub, the stop of the locking bolt being moved transversely by the locking core;

the linking member being mounted in the guide slot of the base, the linking member having a mediate portion formed with a support passing through the opening of the locking bolt, the support having a distal end formed with a side plate located above the electromagnetic valve, the side plate being formed with a locking hole aligning with the locking pin of the electromagnetic valve; and a key having a first end formed with a mechanical unlocking portion inserted into the locking core to drive the locking bolt, thereby detaching the locking lug of the locking bolt from the locking recess of the locking hook, the key having a second end formed with an electromagnetic unlocking portion electromagnetically connected to the electromagnetic sensor which drives the electromagnetic valve which drives the protruding locking pin to retract into the electromagnetic valve and to detach from the locking hole of the locking bolt, so that the linking member can be pushed to slide in the guide slot of the base, and the support of the linking member is moved in the opening of the locking bolt to move the locking bolt, thereby detaching the locking lug of the locking bolt from the locking recess of the locking hook.

Further benefits and advantages of the present invention will become apparent after a careful reading of the detailed description with appropriate reference to the accompanying drawings.

DETAILED DESCRIPTION OF THE INVENTION

Figure 1:
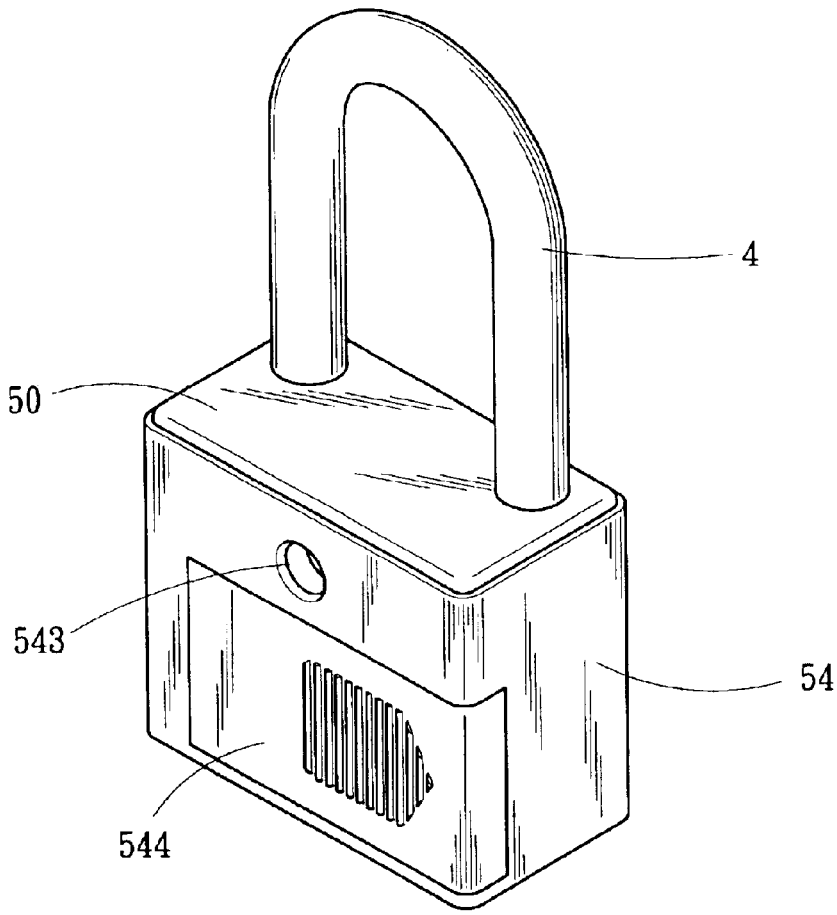
FIG. 1 is a perspective view of a locking device in accordance with the preferred embodiment of the present invention.
Figure 2:
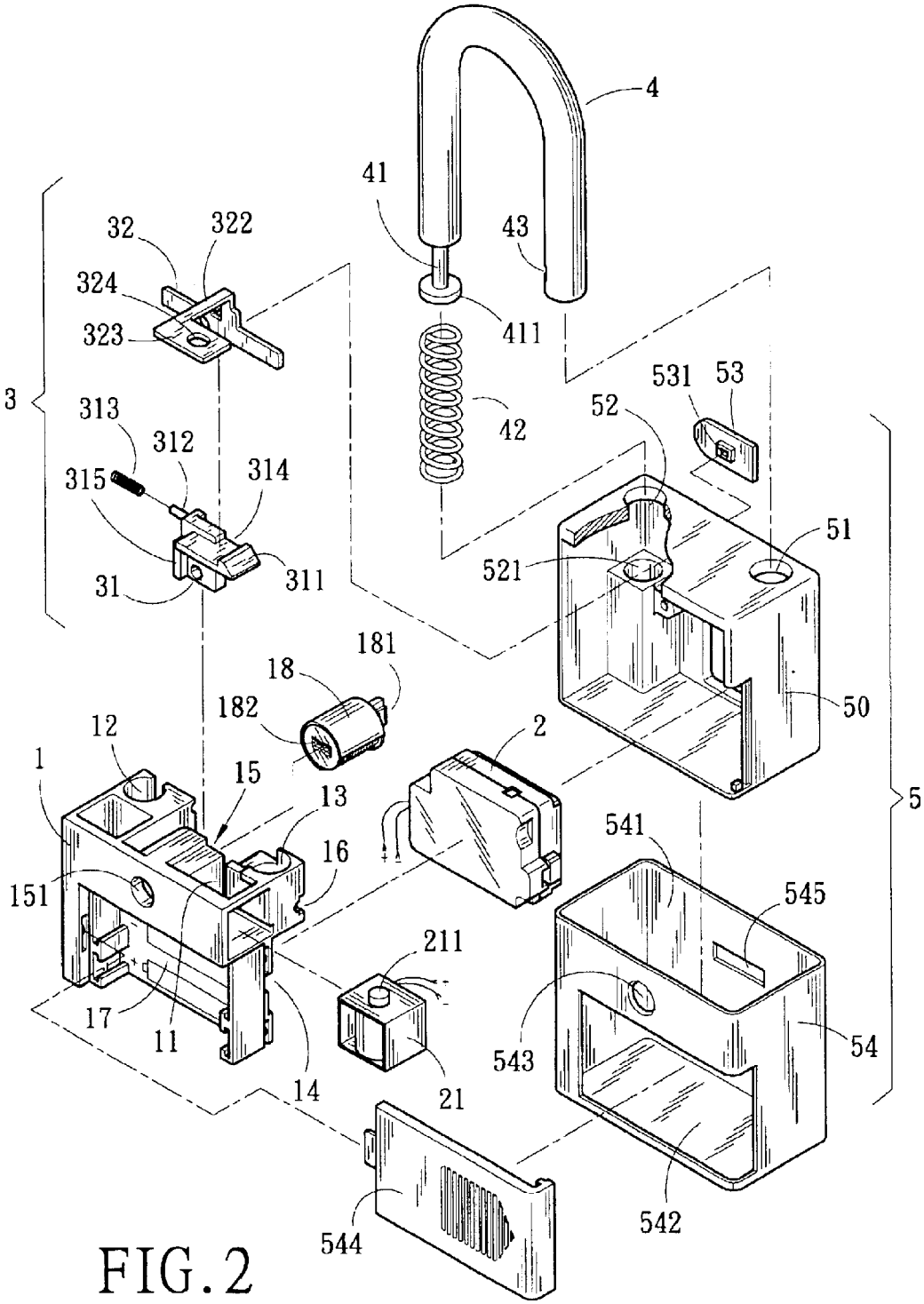
FIG. 2 is an exploded perspective view of the locking device as shown in FIG. 1.
Figure 3:
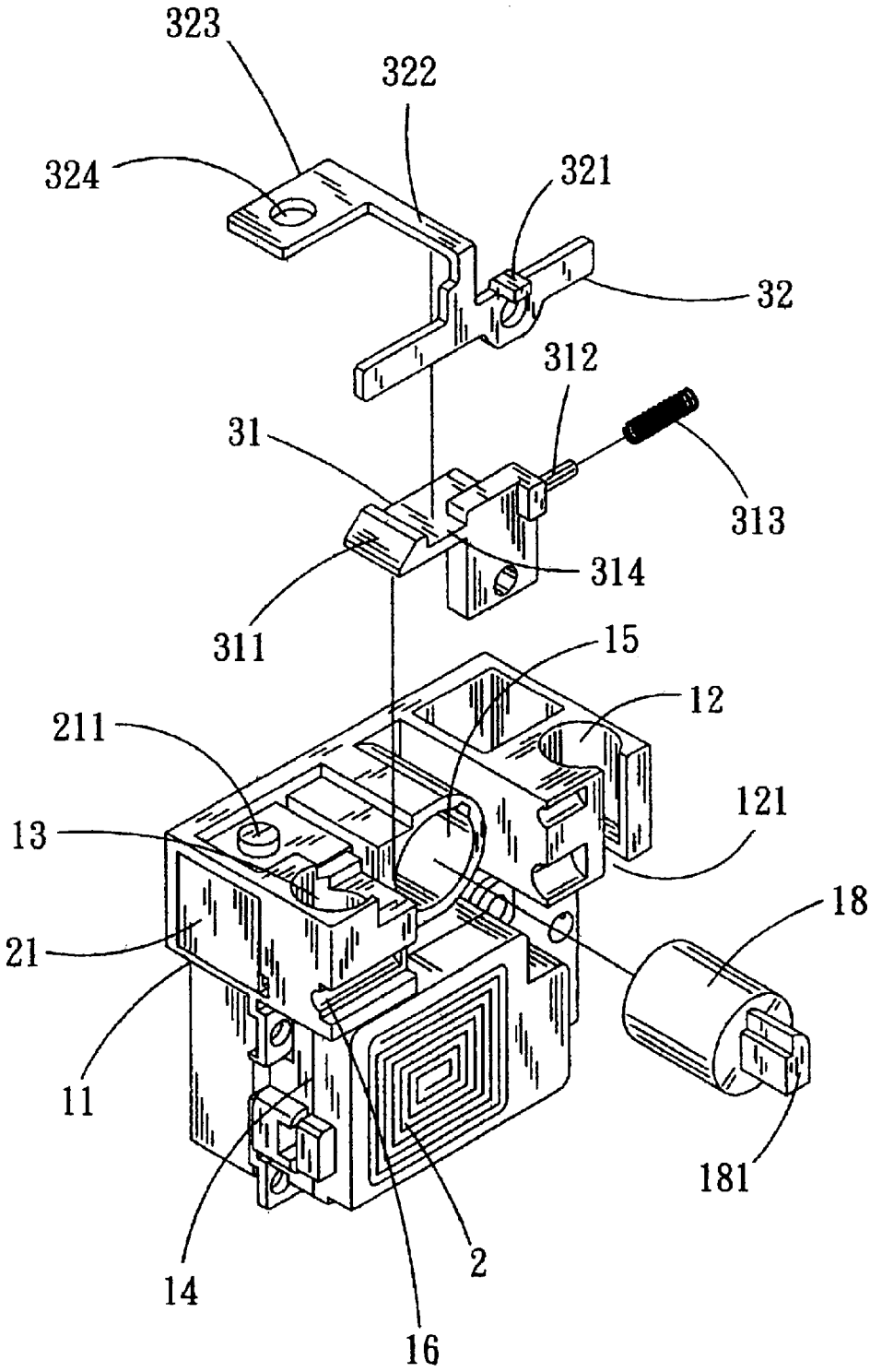
FIG. 3 is a partially exploded perspective view of the locking device as shown in FIG. 1.
Figure 4:
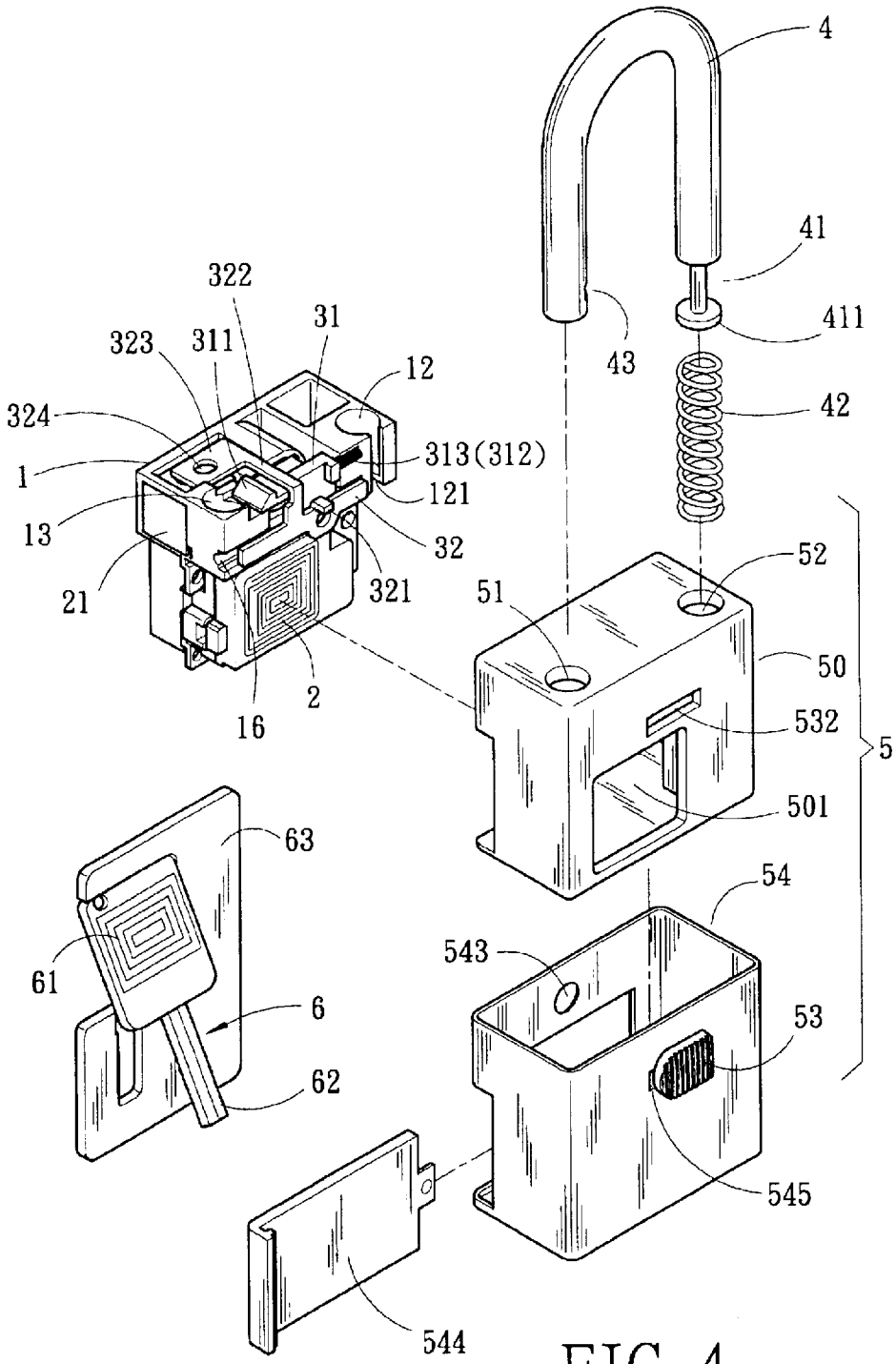
FIG. 4 is a partially exploded perspective view of the locking device as shown in FIG. 1.

Referring to the drawings and initially to FIGS. 1–4, a locking device in accordance with the preferred embodiment of the present invention comprises a base 1, an electromagnetic sensor 2, a locking mechanism 3, a locking hook 4, and a housing 5.

The base 1 has an upper portion formed with an upper receiving space 11, a through hole 12 located beside the upper receiving space 11, a locking hole 13 located beside the upper receiving space 11, and a receiving hole 15 located between the through hole 12 and the locking hole 13. The receiving hole 15 of the base 1 has a bottom formed with a passage hole 151. A locking core 18 is mounted in the receiving hole 15 and has a first end formed with a lug 181 and a second end formed with a key hole 182 communicating with the passage hole 151 of the base 1. The base 1 has a mediate portion formed with a transverse guide slot 16. The base 1 has a lower portion formed with a lower receiving space 14 having a backside formed with a battery seat 17.

The electromagnetic sensor 2 is mounted in the lower receiving space 14 of the base 1 to connect an electromagnetic valve 21 mounted in the upper receiving space 11 of the base 1. The electromagnetic sensor 2 detects predetermined electromagnetic waves to drive the electromagnetic valve 21 which drives a protruding locking pin 211 to retract into the electromagnetic valve 21.

The locking mechanism 3 includes a locking bolt 31, and a linking member 32.

The locking bolt 31 has a first side formed with a wedge-shaped locking lug 311 and a second side formed with a stub 312 for mounting an elastic member 313 which urges the locking lug 311 to extend into the locking hole 13 of the base 1. The locking bolt 31 has an upper portion formed with an opening 314 located between the locking lug 311 and the stub 312 and a lower portion formed with a vertical stop 315 located between the locking lug 311 and the stub 312 and rested on the lug 181 of the locking core 18.

The linking member 32 has a mediate portion formed with a support 322 having a distal end formed with a side plate 323 formed with a locking hole 324. The linking member 32 is mounted in the guide slot 16 of the base 1, and the support 322 of the linking member 32 passes through the opening 314 of the locking bolt 31 and is rested near a side of the stub 312. The support 322 of the linking member 32 has a width smaller than that of the opening 314 of the locking bolt 31. The side plate 323 of the linking member 32 is located above the electromagnetic valve 21, with the locking pin 211 of the electromagnetic valve 21 aligning with the locking hole 324 of the linking member 32.

The locking hook 4 has a bent mediate portion, and has a first end formed with a reduced shaft 41 having a distal end formed with an enlarged catch 411. The shaft 41 of the locking hook 4 is extended into the through hole 12 of the base 1 and is urged on an elastic member 42. The through hole 12 of the base 1 is formed with a reduced catch 121 for stopping the enlarged catch 411 of the locking hook 4, to prevent the shaft 41 of the locking hook 4 from detaching from the through hole 12 of the base 1. The locking hook 4 has a second end formed with a locking recess 43, so that when the second end of the locking hook 4 is inserted into the locking hole 13 of the base 1, the locking lug 311 of the locking bolt 31 is locked in the locking recess 43 of the locking hook 4.

The housing 5 includes an inner casing 50 and an outer casing 54.

The inner casing 50 has a first side formed with an opening for receiving the base 1 and a second side formed with a hollow 501 aligning with the electromagnetic sensor 2 and a slot 532 located above the hollow 501. The inner casing 50 has a top formed with a first through hole 52 aligning with the through hole 12 of the base 1 and a second through hole 51 aligning with the locking hole 13 of the base 1. The inner casing 50 has an inside formed with a receiving hole 521 located below the first through hole 52 for receiving the elastic member 42.

The outer casing 54 is mounted on the inner casing 50, and has a first side formed with a through hole 543 aligning with the passage hole 151 of the base 1 and a hollow 542 aligning with the battery seat 17 of the base 1. A side cover 544 is mounted in the hollow 542 of the outer casing 54. The outer casing 54 has a second side formed with a slot 545 aligning with the slot 532 of the inner casing 50. The linking member 32 has a side protrusion 321 extended through the slot 532 of the inner casing 50 and the slot 545 of the outer casing 54 and inserted into a recess 531 of a drive plate 53 which is slidably mounted on the outer casing 54, so that the linking member 32 is moved by the drive plate 53.

A key 6 has a first end formed with a mechanical unlocking portion 62 inserted into the key hole 182 of the locking core 18 and a second end formed with an electromagnetic unlocking portion 61 electromagnetically connected to the electromagnetic sensor 2. The key 6 is mounted on a protective card 63 to facilitate carrying.

Figure 5A:
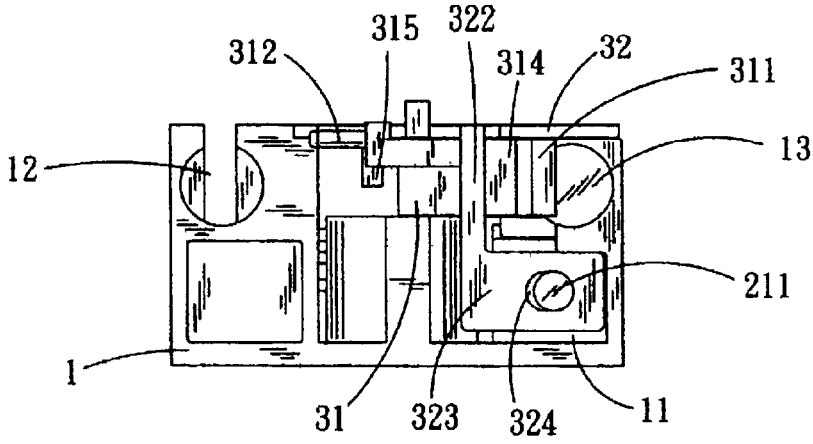
FIG. 5A is a top plan view of the locking device as shown in FIG. 1.
Figure 5:
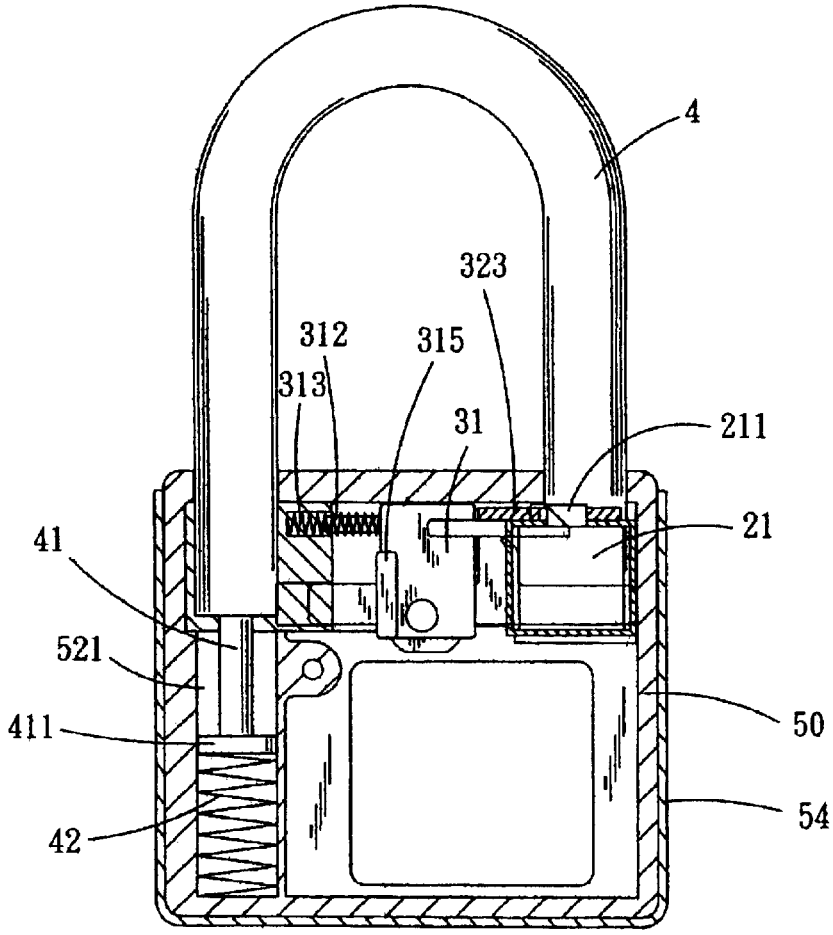
FIG. 5 is a front plan cross-sectional view of the locking device as shown in FIG. 1.
Figure 6A:
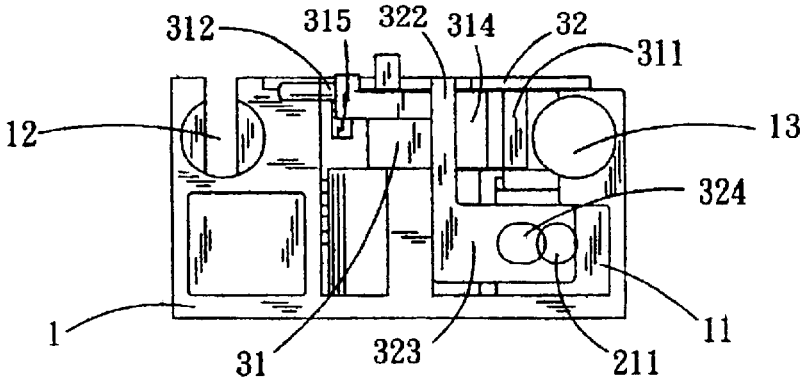
FIG. 6A is a schematic operational view of the locking device as shown in FIG. 5A.
Figure 6:
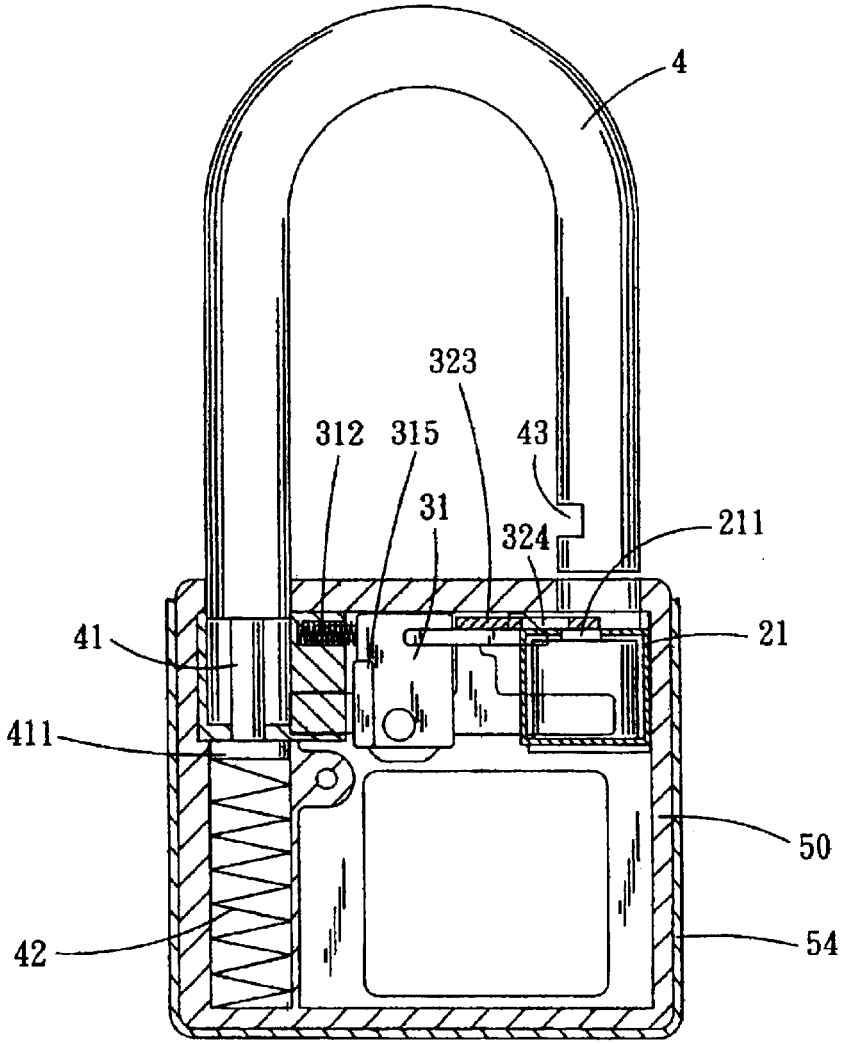
FIG. 6 is a schematic operational view of the locking device as shown in FIG. 5.

In operation, referring to FIGS. 5 and 6 with reference to FIGS. 1–4, when the locking device is disposed at the locked state, the locking lug 311 of the locking bolt 31 is locked in the locking recess 43 of the locking hook 4, and the locking pin 211 of the electromagnetic valve 21 is inserted into the locking hole 324 of the linking member 32 to position the linking member 32. At this time, the linking member 32 cannot be moved by the drive plate 53, and the locking bolt 31 is disposed at the locked state. When the electromagnetic unlocking portion 61 of the key 6 approaches the electromagnetic sensor 2, the electromagnetic sensor 2 detects the predetermined electromagnetic waves to drive the electromagnetic valve 21 which drives the protruding locking pin 211 to retract into the electromagnetic valve 21, thereby detaching the locking pin 211 of the electromagnetic valve 21 from the locking hole 324 of the linking member 32 so as to unlock the linking member 32. At this time, the drive plate 53 is moved by the user to drive the linking member 32 to slide in the guide slot 16 of the base 1 so that the support 322 of the linking member 32 is moved in the opening 314 of the locking bolt 31 to press a side of the stub 312 of the locking bolt 31 to compress the elastic member 313 and to move the locking bolt 31, thereby detaching the locking lug 311 of the locking bolt 31 from the locking recess 43 of the locking hook 4. Thus, the enlarged catch 411 of the locking hook 4 is pushed upward by the elastic member 42, so that the locking hook 4 is pushes outward to unlock the locking device.

After the drive plate 53 is released by the user, the locking bolt 31 is pressed by the elastic member 313, so that the locking lug 311 of the locking bolt 31 is pushed to extend into the locking hole 13 of the base 1. At this time, when the locking hook 4 is pressed downward, the free end of the locking hook 4 is extended through the second through hole 51 of the inner casing 50 into the locking recess 43 of the locking hook 4 to press the locking lug 311 of the locking bolt 31 and to compress the elastic member 313, so that the locking lug 311 of the locking bolt 31 is locked in the locking recess 43 of the locking hook 4 by the elastic member 313.

Figure 7:
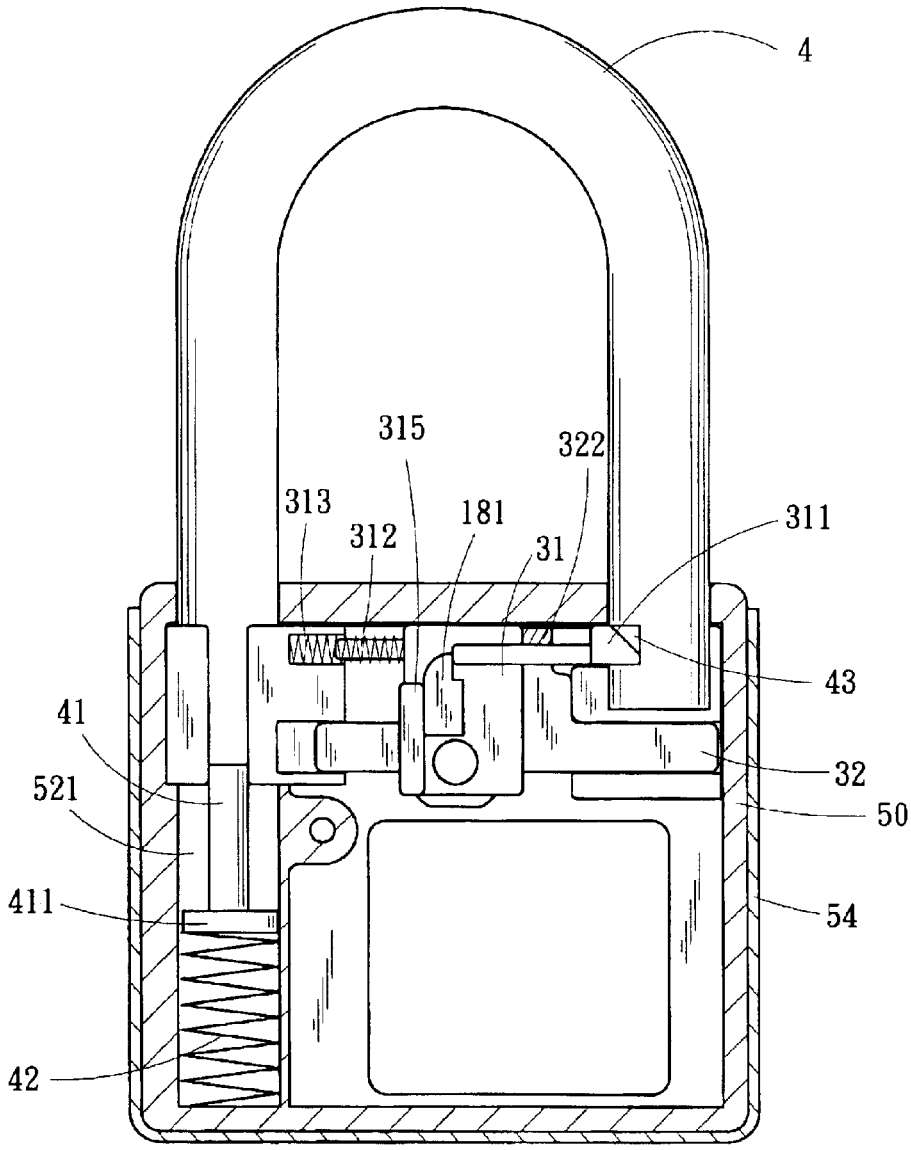
FIG. 7 is a front plan cross-sectional view of the locking device as shown in FIG. 1.
Figure 8:
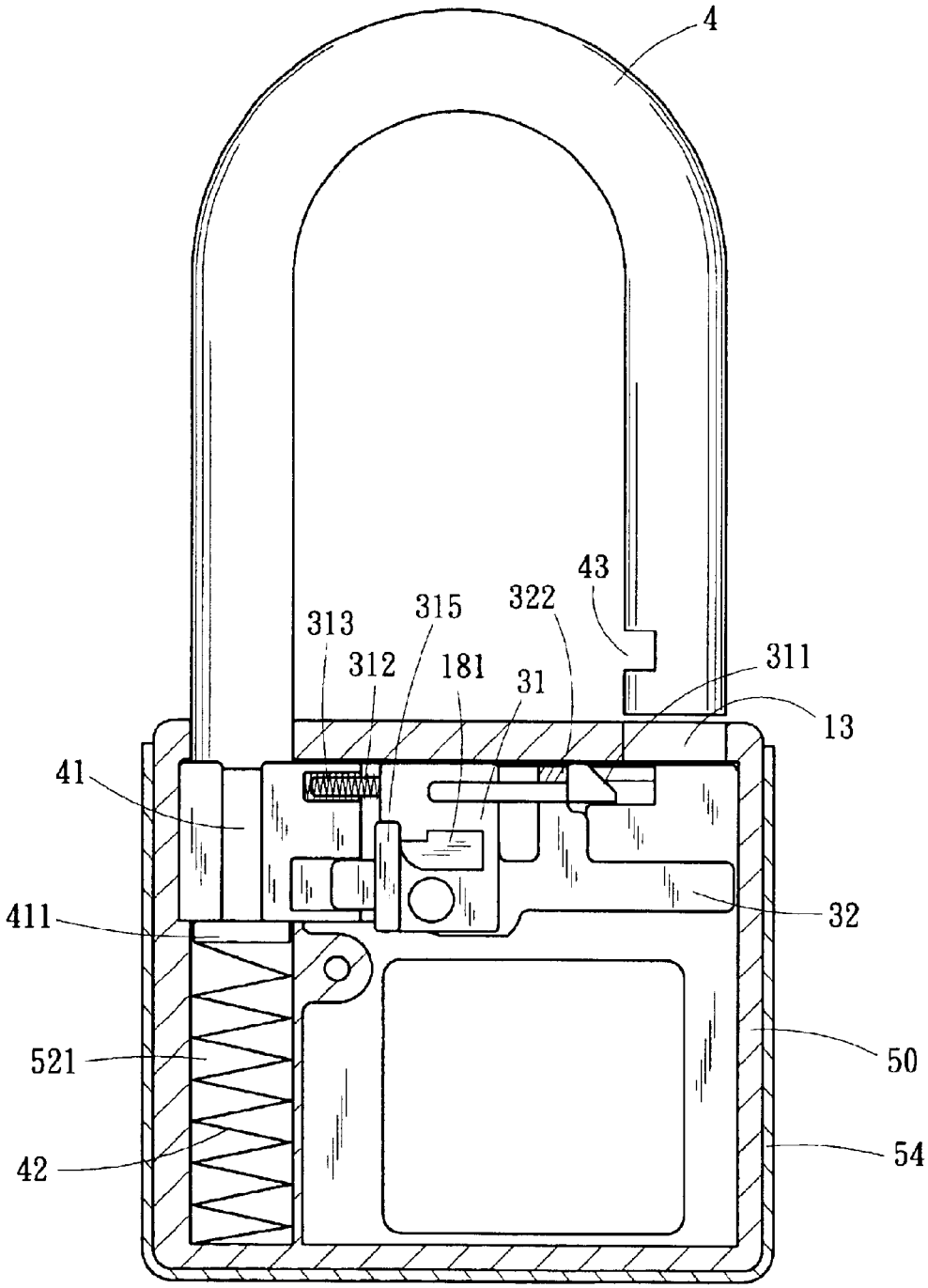
FIG. 8 is a schematic operational view of the locking device as shown in FIG. 7.

Referring to FIGS. 7 and 8 with reference to FIGS. 1–4, when the locking device is disposed at the locked state, the locking lug 311 of the locking bolt 31 is locked in the locking recess 43 of the locking hook 4, and the locking pin 211 of the electromagnetic valve 21 is inserted into the locking hole 324 of the linking member 32 to position the linking member 32. At this time, the linking member 32 cannot be moved by the drive plate 53, and the locking bolt 31 is disposed at the locked state. Then, the mechanical unlocking portion 62 of the key 6 is extended through the through hole 543 of the outer casing 54 and the passage hole 151 of the base 1 and is inserted into the key hole 182 of the locking core 18 to rotate the locking core 18, so that the lug 181 of the locking core 18 is rotated to push the stop 315 of the locking bolt 31 to move the locking bolt 31 and to compress the elastic member 313, thereby detaching the locking lug 311 of the locking bolt 31 from the locking recess 43 of the locking hook 4. Thus, the enlarged catch 411 of the locking hook 4 is pushed upward by the elastic member 42, so that the locking hook 4 is pushes outward to unlock the locking device. At this time, the support 322 of the linking member 32 has a width smaller than that of the opening 314 of the locking bolt 31, so that the support 322 of the linking member 32 will not interfere with movement of the locking bolt 31.

Accordingly, the locking device can be opened by the mechanical unlocking portion 62 of the key 6 and the electromagnetic unlocking portion 61 of the key 6, thereby enhancing the versatility of the locking device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A locking device, comprising:

a housing;

a base mounted in the housing and having an upper portion formed with an upper receiving space, a through hole located beside the upper receiving space, a locking hole located beside the upper receiving space, and a receiving hole located between the through hole and the locking hole for mounting a locking core, the base having a mediate portion formed with a transverse guide slot and having a lower portion formed with a lower receiving space having a backside formed with a battery seat;

an electromagnetic sensor mounted in the lower receiving space of the base to connect an electromagnetic valve mounted in the upper receiving space of the base, the electromagnetic sensor detecting electromagnetic waves to drive the electromagnetic valve which drives a protruding locking pin to retract into the electromagnetic valve;

a locking hook having a bent mediate portion and having a first end extended into the through hole of the base and urged on a first elastic member and a second end formed with a locking recess inserted into the locking hole of the base;

a locking mechanism including a locking bolt, and a linking member;

the locking bolt having a first side formed with a wedge-shaped locking lug and a second side formed with a stub for mounting a second elastic member which urges the locking lug to extend into the locking hole of the base, the locking bolt having an upper portion formed with an opening located between the locking lug and the stub and a lower portion formed with a vertical stop located between the locking lug and the stub, the stop of the locking bolt being moved transversedly by the locking core;

the linking member being mounted in the guide slot of the base, the linking member having a mediate portion formed with a support passing through the opening of the locking bolt, the support having a distal end formed with a side plate located above the electromagnetic valve, the side plate being formed with a locking hole aligning with the locking pin of the electromagnetic valve; and a key having a first end formed with a mechanical unlocking portion inserted into the locking core to drive the locking bolt, thereby detaching the locking lug of the locking bolt from the locking recess of the locking hook, the key having a second end formed with an electromagnetic unlocking portion electromagnetically connected to the electromagnetic sensor which drives the electromagnetic valve which drives the protruding locking pin to retract into the electromagnetic valve and to detach from the locking hole of the linking member, so that the linking member can be pushed to slide in the guide slot of the base, and the support of the linking member is moved in the opening of the locking bolt to move the locking bolt, thereby detaching the locking lug of the locking bolt from the locking recess of the locking hook.

2. The locking device in accordance with claim 1, wherein the support of the linking member has a width smaller than that of the opening of the locking bolt.

3. The locking device in accordance with claim 1, wherein the support of the linking member is rested near a side of the stub.

4. The locking device in accordance with claim 1, wherein the locking core has an end formed with a lug, and the stop of the locking bolt is rested on the lug of the locking core.

5. The locking device in accordance with claim 1, wherein the receiving hole of the base has a bottom formed with a passage hole, the locking core has an end formed with a key hole communicating with the passage hole of the base.

6. The locking device in accordance with claim 5, wherein the mechanical unlocking portion of the key is inserted into the key hole of the locking core.

7. The locking device in accordance with claim 1, wherein the housing includes an inner casing and an outer casing mounted on the inner casing.

8. The locking device in accordance with claim 7, wherein the inner casing has a side formed with an opening for receiving the base.

9. The locking device in accordance with claim 7, wherein the inner casing has a side formed with a hollow aligning with the electromagnetic sensor.

10. The locking device in accordance with claim 7, wherein the inner casing has a top formed with a first through hole aligning with the through hole of the base and a second through hole aligning with the locking hole of the base.

11. The locking device in accordance with claim 10, wherein the inner casing has an inside formed with a receiving hole located below the first through hole for receiving the first elastic member.

12. The locking device in accordance with claim 7, wherein the outer casing has a side formed with a hollow aligning with the battery seat of the base.

13. The locking device in accordance with claim 12, wherein the housing further includes a side cover mounted in the hollow of the outer casing.

14. The locking device in accordance with claim 7, wherein the receiving hole of the base has a bottom formed with a passage hole, the locking core has an end formed with a key hole communicating with the passage hole of the base, and the outer casing has a side formed with a through hole aligning with the passage hole of the base.

15. The locking device in accordance with claim 7, wherein the inner casing has a side formed with a slot, the outer casing has a side formed with a slot aligning with the slot of the inner casing, and the linking member has a side protrusion extended through the slot of the inner casing and the slot of the outer casing and inserted into a recess of a drive plate which is slidably mounted on the outer casing, so that the linking member is moved by the drive plate.

16. The locking device in accordance with claim 1, wherein the key is mounted on a protective card.

17. The locking device in accordance with claim 1, wherein the first end of the locking hook is formed with a reduced shaft having a distal end formed with an enlarged catch.

18. The locking device in accordance with claim 17, wherein the shaft of the locking hook is extended into the through hole of the base and is urged on the first elastic member.

19. The locking device in accordance with claim 18, wherein the through hole of the base is formed with a reduced catch for stopping the enlarged catch of the locking hook, to prevent the shaft of the locking hook from detaching from the through hole of the base.

20. The locking device in accordance with claim 1, wherein when the second end of the locking hook is inserted into the locking hole of the base, the locking lug of the locking bolt is locked in the locking recess of the locking hook.

* * * * *